United States Patent [19]

Wang et al.

[11] 4,090,972

[45] May 23, 1978

[54] EFFECTIVE PROMOTER EXTENDER FOR CONVENTIONAL FATTY ACIDS IN NON-SULFIDE MINERAL FLOTATION

[75] Inventors: Samuel Shan-Ning Wang, New Haven; Eugene Leroy Smith, Jr., Stamford, both of Conn.

[73] Assignee: American Cyanamid Company, Stamford, Connecticut 06904

[21] Appl. No.: 723,842

[22] Filed: Sep. 16, 1976

[51] Int. Cl.[2] ..... B03D 1/00

[52] U.S. Cl. ..... 252/61; 209/166

[58] Field of Search ..... 252/61; 209/166, 167

[56] References Cited

U.S. PATENT DOCUMENTS

| | | | |
|---|---|---|---|
| 2,012,609 | 8/1935 | Lenher | 209/166 |
| 2,065,053 | 12/1936 | Christmann et al. | 209/166 |
| 2,377,129 | 5/1945 | Christmann et al. | 209/166 |

*Primary Examiner*—Harris A. Pitlick

*Attorney, Agent, or Firm*—William J. van Loo

[57] ABSTRACT

The use of a secondary alcohol or an ethoxylated secondary alcohol in conjunction with conventional fatty acid in the flotation of non-sulfide minerals eliminates or reduces requirements for fuel oil usage.

5 Claims, No Drawings

EFFECTIVE PROMOTER EXTENDER FOR CONVENTIONAL FATTY ACIDS IN NON-SULFIDE MINERAL FLOTATION

CROSS-REFERENCE TO RELATED APPLICATIONS

This application is related to application Ser. No. 723,841 filed on even date herewith.

This application relates to a collector combination while the copending application relates to use of a related composition in flotation of non-sulfide minerals.

This invention relates to an improved process for beneficiating non-sulfide ores by froth flotation. More particularly, it relates to such a process wherein selected extenders for the principal collector provide improved recovery and reduce requirements for fuel oil.

Froth flotation is the principal means by which non-sulfide ores such as phosphate, barite, fluorite, hematite, taconite, magnetite and a host of other ores are concentrated. Its chief advantage lies in the fact that it is a relatively efficient process operating at substantially lower costs than many other processes.

Flotation is a process for separating finely ground valuable minerals from their associated gangue, or waste, or for separating valuable components one from another. In froth flotation, frothing occurs by introducing air into a pulp of finely divided ore and water containing a frothing agent. Minerals that have a special affinity for air bubbles rise to the surface in the froth and are separated from those wetted by the water. The particles to be separated by froth flotation must be of a size that can be readily levitated by the air bubbles.

Agents called collectors are used in conjunction with flotation to promote recovery of the desired material. The agents chosen must be capable of selectively coating the desired material in spite of the presence of many other mineral species. Current theory states that the flotation separation of one mineral species from another depends upon the relative wettability of surfaces. Typically, the surface free energy is purportedly lowered by the adsorption of heteropolar surface-active agents. The hydrophobic coating thus provided acts in this explanation as a bridge so that the particle may be attached to an air bubble. The practice of this invention is not limited by this or other theories of flotation.

Non-sulfide minerals are generally beneficiated by froth flotation using a suitable acid as the collector. Such acids are generally fatty acids that are derived from naturally occurring materials, such as vegetable and animal oils. The edible oils are in great demand in applications relating to their edible characteristics due to their short supply and consequently their availability for other applications such as sources of acids for collector use in mining operations has been seriously reduced. Other naturally occurring oils which are not edible, such as tall oils, have found extensive use in coating applications and, similarly, their availability for other uses is severely limited.

The use of fatty acids in the froth flotation of non-sulfide minerals can best be typified by phosphate rock. Typically, phosphate ore containing about 15–35% BPL [bone phosphate of lime, $Ca_3(PO_4)_2$] is concentrated in very large tonnages from Florida pebble phosphate deposits. The ore slurry from strip mining is sized at about 1 millimeter and the coarser friction, after scrubbing to break up mud balls, is a finished product. The minus 1 mm fraction is further sized at 35 and 200 mesh. The minus 200 mesh slime is discarded. From the sizing operation, the +35 mesh material in thick slurry is treated with fatty acid fuel oil, and caustic, ammonia or other alkaline material and the resulting agglomerates are separated on shaking tables, spirals, or spray belts. The 35 × 200 mesh fraction is conditioned with the same type or reagents and floated by conventional froth flotation routes. Not all the silica gangue is rejected by the fatty acid flotation, so the concentrate is blunged with acid to remove collector coatings, deslimed, washed free of reagents, and subjected to an amine flotation with fuel oil at pH 7-8. This latter flotation, sometimes called "cleaning," removes additional silica and raises the final concentrate grade to 75–80% BPL.

In the operation as described, it is to be noted that fuel oil is used in conjunction with the fatty acid collector. The fuel oil usage is generally equal to ¼ to 4X amount of fatty acid employed. In its role as extender, the fuel oil provides a greater level of recovery than can be obtained from the specific dosage level of fatty acid employed alone although fuel oil per se is not an effective collector. Thus fuel oil serves an important role in the flotation process over and above its ability to curtail excessive frothing.

At the present time fuel oil, as well as other energy fuels, are in critical shortage and constantly become more expensive to use. Thus, the froth flotation of non-sulfide ores with acid collectors, especially when fuel oil usage is also contemplated, presents serious problems with respect to availability of processing materials required. At the same time, the mineral values obtained from processing non-sulfide minerals have also increased in demand, for example, phosphate values for the ever-increasing supplies of fertilizers needed to provide agricultural products to meet the world's food requirements.

Although the froth flotation procedure described above is effective in the recovery of BPL from phosphate rock, as are other preocesses involving other non-sulfide ores, there nevertheless exists the need for improvements which will maintain high recovery values at high grade while reducing or eliminating the requirements for materials which are in short supply, such as edible oils and fuel oils. In view of the high quantities of non-sulfide ores processed by froth flotation such a development can result in substantial economic advantages and free the oils for more urgent usages.

In accordance with the present invention there is provided a process for the beneficiation of non-sulfide ores which comprises classifying the ore to provide particles of flotation size, slurrying the sized ore in aqueous medium, conditioning the slurry with effective amounts of a fatty acid derived from a vegetable or animal oil and a linear secondary alcohol of the formula:

$$CH_3\text{-}(CH_2)_x\underset{\underset{O\text{-}(CH_2CH_2O)_n\text{-}H}{|}}{CH}\text{-}(CH_2)_y\text{-}CH_3$$

wherein $x$ and $y$ are individually zero or integers such that the sum of $x$ and $y$ provides a secondary alcohol of about 8–20 carbon atoms, exclusive of any ethoxylate content, and $n$ is an integer of 0–10, and thereafter floating the desired ore values by froth flotation, the weight ratio of said fatty acid to said alcohol being from about 99:1 to about 3:1.

The process of the present invention provides higher recovery of non-sulfide minerals while maintaining high grade. In instances where fuel oil is normally required, the present invention eliminates or significantly reduces requirements for fuel oil. The present invention provides high recovery at reduced dosages of collector and thus can reduce the requirements for scarce fatty acids. By providing higher recovery of non-sulfide ores, the present invention increases the availability of valuable minerals without increasing requirements for scarce oils.

The results provided by the present invention are highly surprising and, therefore, completely unexpected for the following reasons:

1. The linear secondary aliphatic alcohols employed are effective extenders while the corresponding linear primary aliphatic alcohols are not.

2. The linear secondary aliphatic alcohols employed are effective extenders at a small fraction of the usage required with fuel oils.

3. The combination of fatty acid and linear secondary aliphatic alcohol reduces total reagent usage for a given level of mineral recovery in spite of the fact that the linear secondary aliphatic alcohol per se is not an effective collector.

An added feature of the present invention is the fact that the linear secondary aliphtic alcohols are readily biodegradable and present no pollution problems in effluent streams whereas other extenders are more resistant to biodegradation.

In carrying out the process of the present invention, a non-sulfide mineral is selected for treatment. Such minerals include phosphate rock, barite, fluorite, hematite, taconite, magnetite and the like that are conventionally processed by froth flotation. Particularly beneficial results are achieved when phosphate rock is selected as the non-sulfide ore because the present process can eliminate or significantly reduce the requirements for fuel oil that is conventionally employed and, accordingly, phosphate rock is a preferred ore. The selected mineral is screened to provide particles of flotation size according to conventional procedures. Generally, the flotation size will encompass from about 35 × 150 mesh particles.

After the selected mineral has been sized as indicated it is slurried in aqueous medium at a solids level consistent with conventional processing, the solids level varying widely depending upon the particular non-sulfide ore selected. The slurried ore is then conditioned with effective amounts of fatty acid and linear secondary aliphatic alcohol. Other additives conventionally employed may also be used, if desired. For example, frothers, pH regulators, fuel oil, and the like amy be used in accordance with conventional processing, if desired, depending upon the particular non-sulfide ore selected but, as indicated above, requirements for fuel oil can be eliminated or significantly reduced, if desired. Generally, the effective amount of fatty acid will vary over wide ranges depending upon the particular ore selected and the condition of the ore. An effective amount is generally found in the range of about 0.2 to about 2.0, preferably about 0.5 to 1.0 pounds of fatty acid per ton of ore. The amount of linear secondary aliphatic alcohol will generally be such that the weight ratio of fatty acid to such alcohol is from about 99:1 to about 3:1, preferably about 10:1 to 7:1.

The useful fatty acids are those derived from a vegetable or animal oil. Vegetable oils include babassu, castor, Chinese Tallow, coconut, corn, cottonseed, grapeseed, hempseed, hapok, linseed, wild mustard, oiticica, olive, ouri-ouri, palm, palm kernel, peanut, perilla, poppyseed, Argentine rapeseed, rubberseed, safflower, sesame, soybean, sugarcane, sunflower, tall, teaseed, tung, and ucuhuba oils. Animal oils include oils derived from fish and livestock. These oils contain acids ranging from six to twenty-eight carbons or more and may be saturated or unsaturated, hydroxylated or not, linear or cyclic, and the like.

The linear secondary aliphatic alcohol is one having the structure:

$$CH_3(CH_2)_x\underset{\underset{O(CH_2CH_2O)_nH}{|}}{CH}(CH_2)_yCH_3$$

wherein $x$ and $y$ are individually zero or integers such that the sum of $x$ and $y$ provide an alcohol having a total of about 8 to 20 carbonatoms exclusive of any ethoxylate content and $n$ is zero or an integer of about 1 to 10. Preferred species are those in which the sum of $x$ and $y$ is about 8 to 12 and $n$ is equal to 2 to 7.

The invention is more fully illustrated by the examples which follow wherein all parts and percentages are by weight unless otherwise specified. Although the invention is illustrated with phosphate minerals, it is to be understood that benefits as described are obtainable with other non-sulfide minerals. The following general procedure was employed in the froth flotation examples given.

GENERAL PROCEDURE

Rougher Float

Step 1: Secure washed and sized feed, e.g., 35 × 150 mesh screen fractions. Typical feed is usually a mixture of 23% coarse with 77% fine flotation particles.

Step 2: Take sufficient wet sample, usually 640 grams, to give a dry weight equivalent of 500 grams. The sample is washed once with about an equal weight of tap water. The water is carefully decanted to avoid loss of solids.

Step 3: The moist sample is conditioned for one minute with approximately 100 cc of water, sufficient caustic as 5–10% aqueous solution to obtain the pH desired (pH 9.5–9.6) a mixture of 50% acid and fuel oil and additional fuel oil as necessary. Additional water may be necessary to give the mixture the consistency of "oatmeal" (about 69% solids). The amount of caustic will vary from 4 to about 20 drops. This is adjusted with a pH meter for the correct end point. At ehe end of the conditioning, additional caustic may be added to adjust the endpoint. However, an additional 15 seconds of conditioning is required if additional caustic is added to adjust the pH. Five to about 200 drops of acid-oil mixture and one-half this amount of additional oil is used, depending on the treatment level desired.

Step 4: Conditioned pulp is placed in an 800-gram bowl of a flotation machine and approximately 2.6 liters of water are added (enough water to bring the pulp level to lip of the container). The percent solids in the cell is then about 14%. The pulp is floated for 2 minutes with air introduced after 10 seconds of mixing. The excess water is carefully decanted from the rougher products. The tails are set aside for drying and analysis.

Step 5: The products are oven dried, weighed, and analyzed for weight percent $P_2O_5$ or BPL. Recovery of mineral values is calculated using the formula:

$$\frac{(W_c)(P_c)}{(W_c)(P_c) + (W_t)(P_t)} \times 100$$

wherein $W_c$ and $W_t$ are the dry weights of the concentrate and tailings, respectively, and $P_c$ and $P_t$ are the weight percent $P_2O_5$ or BPL of the concentrate or tails, respectively.

COMPARATIVE EXAMPLE A

Following the General Procedure described above, a series of runs were made using a fatty acid with increasing amounts of No. 5 Fuel Oil to demonstrate the extender effects of this oil additive. The fatty acid was a reconstituted fatty acid obtained by the fractionation of tall oil and subsequent recombination of appropriate fractions. Results of froth flotation are given in Table I.

COMPARATIVE EXAMPLES B AND C

The general Procedure was again followed using the fatty acid used in Comparative Example A. However, in place of the fuel oil, there were used in separate runs two alternative extenders. In Comparative Example B, the alternative extender was a polyoxyethylene ether of a mixture of $C_{12}$ and $C_{13}$ linear aliphatic primary alcohols having three ethylene oxide units. In Comparative Example C, the alternative extender was the mixture of free primary alcohols used to obtain the polyoxyethylene ether of Comparative Example B. Results of froth flotation are also given in Table I. Although the results indicate that fuel oil may be replaced by alternative extenders, the particular extenders used, primary aliphatic alcohol and ethoxylated primary aliphatic alcohol do not provide the recovery and grade values desired.

COMPARATIVE EXAMPLES D AND E

The General Procedure was again followed using a fatty acid derived from tall oil. In Comparative Example D, the tall oil fatty acid was used alone and in Comparative Example E, the fatty acid was used with an equal amount of No. 5 fuel oil as extender. Results of froth flotation are also given in Table I and demonstrate the externder effects of fuel oil.

COMPARATIVE EXAMPLES F, G, AND H

The General Procesure was again followed using the fatty acid of Comparative Example D. In place of the No. 5 fuel oil employed in Comparative Example E, there were used alternative extenders. In Comparative Example F, there were used polyoxyethylene ethers of mixed fatty and rosin acids. In Comparative Example G, there was used the polyoxyethylene ether of mixed linear aliphatic primary alcohols of 12 to 14 carbon atoms. In Comparative Example H, there was employed the mixed linear aliphatic primary alcohols from which the polyoxethylene ether of Comparative Example G was obtained. The results of froth flotation are also given in Table I and show that the extenders of Comparative Examples F, G, and H are not effective compared to fuel oil as employed in Comparative Example E.

EXAMPLE 1

The General Procedure was again followed. The fatty acid employed was the same as that employed in Comparative Examples D–H. As extender, there was employed a polyoxyethylene ether of a mixture of linear secondary aliphatic slcohols of the structure:

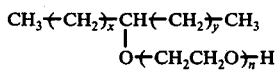

wherein $x + y$ is equal to 8 to 12 and $n$ is equal to 3. Flotation results are also shown in Table I. The results show that the extender of Example 1 provides high recovery at high grade while eliminating the need for fuel oil, reduces the total requirement of reagents, and reduces the acid requirements.

TABLE I

| EXAMPLE | FATTY ACID | USAGE Lb./Ton | EXTENDER | USAGE Lb./Ton | WEIGHT RECOVERY % | BPL % Feed | BPL % Tail | BPL % Conc. | RECOVERY (%) |
|---|---|---|---|---|---|---|---|---|---|
| A-1 | Tall Oil, Recon. | 1.0 | No. 5 Fuel Oil | 1.0 | 14.65 | 16.07 | 8.06 | 62.75 | 57.21 |
| A-2 | " | 1.0 | No. 5 Fuel Oil | 1.5 | 23.28 | 16.65 | 2.62 | 62.88 | 87.93 |
| A-3 | " | 1.0 | No. 5 Fuel Oil | 2.0 | 24.62 | 24.62 | 1.46 | 61.55 | 93.22 |
| B | " | 1.0 | PAPOEE[1] | 0.2 | 27.10 | 16.32 | 3.23 | 51.54 | 85.58 |
| C | " | 1.2 | PAPOEE | 0.2 | 25.14 | 16.68 | 2.67 | 57.29 | 88.09 |
| D | Tall Oil | 1.0 | NONE | 0.0 | 19.40 | 16.34 | 4.72 | 64.65 | 75.79 |
| E | " | 1.5 | No. 5 Fuel Oil | 1.5 | 25.19 | 16.65 | 1.51 | 61.60 | 93.21 |
| F | " | 0.9 | POEE ESTER[2] | 0.1 | 13.47 | 13.87 | 6.14 | 63.58 | 62.72 |
| G | " | 0.9 | PA[3] | 0.1 | 18.59 | 17.28 | 6.82 | 63.08 | 67.86 |
| H | " | 0.9 | PA | 0.1 | 19.47 | 16.88 | 5.20 | 65.18 | 75.19 |
| I | " | 0.9 | SAPOEE[4] | 0.1 | 22.03 | 14.88 | 1.53 | 62.12 | 91.99 |

NOTES:
[1]PRIMARY ALKOXY POLYOXYETHYLENE ALCOHOL
[2]POLYOXYETHYLENE ESTER ALCOHOL OF MIXED FATTY ACID
[3]PRIMARY ALCOHOL
[4]SECONDARY ALKOXY POLYOXYETHYLENE ALCOHOL

COMPARATIVE EXAMPLE I

The general procedure was followed using tall oil fatty acid alone as collector. Details and results are given in Table II.

COMPARATIVE EXAMPLE J

Comparative Example I was repeated in every detail except that No. 5 fuel oil was used in addition to the fatty acid. Details and results are given in Table II.

EXAMPLE 2

A mixture of 90 parts of tall oil fatty acid and 10 parts of the oxyethylene ether of mixed $C_{11}$–$C_{15}$ secondary alcohols in which three moles of ethylene oxide per mole of alcohol is present was used as collector following the general procedure. Details and results are given in Table II.

EXAMPLE 3

Example 2 was followed in every material detail except that No. 5 fuel oil was used in addition to the collector mixture. Details and results are given in Table II.

EXAMPLE 4

A mixture of 90 parts of tall fatty acid and 10 parts of mixed $C_{11}$ to $C_{15}$ secondary alcohols was used as collector following the general procedures. Details and results are given in Table II.

EXAMPLE 5

The procedure of Example 4 was followed except that No. 5 fuel oil was used in addition to the collector mixture. Details and results are given in Table II.

TABLE II

| EXAMPLE | USAGE Lb./Ton | No. 5 FUEL OIL Lb./Ton | WEIGHT RECOVERY % | BPL % Feed | BPL % Tail | BPL % Conc. | BPL RECOVERY (%) |
|---|---|---|---|---|---|---|---|
| COMPARATIVE I | 0.50[1] | — | 30.04 | 22.4 | 4.18 | 64.83 | 68.95 |
| COMPARATIVE J | 0.50[1] | 0.25 | 31.73 | 22.68 | 3.16 | 64.68 | 90.49 |
| 2 | 0.50[2] | — | 32.57 | 23.21 | 2.93 | 65.20 | 91.49 |
| 3 | 0.50[2] | 0.25 | 32.98 | 22.51 | 2.32 | 63.54 | 93.09 |
| 4 | 0.50[3] | — | 33.36 | 22.47 | 2.62 | 62.12 | 92.23 |
| 5 | 0.50[3] | 0.25 | 33.57 | 22.60 | 2.40 | 62.56 | 92.75 |

NOTES: [1]TALL OIL FATTY ACID COLLECTOR
[2]90/10 TALL OIL FATTY ACID/ETHOXYLATED (3 MOLES) $C_{11}$-$C_{15}$ SECONDARY ALCOHOLS
[3]90/10 TALL OIL FATTY ACID/$C_{11}$-$C_{15}$ SECONDARY ALCOHOLS

The data given in Table II show that high recovery is obtained without the use of fuel oil when part of the fatty acid collector is replaced with a secondary alcohol or an ethoxylated secondary alcohol. The data also show that reduced fuel oil usage provides some increse in recovery when the combination of fatty cid and secondary alcohol or ethoxylated secondary alcohol is employed.

We claim:

1. A collector combination for non-sulfide ores comprising a fatty acid derived from a vegetable or animal oil and a linear secondary alcohol of the formula:

$$CH_3\text{-}(CH_2)_x\underset{\underset{O\text{-}(CH_2CH_2O)_n\text{-}H}{|}}{CH}\text{-}(CH_2)_y\text{-}CH_3$$

wherein $x$ and $y$ are individually zero or integers such that the sum of $x$ and $y$ provides an alcohol having a total of about 8 to 20 carbon atoms exclusive of an ethoxylate content and $n$ is an integer of 0 to 10, the weight ratio of said fatty acid to said alcohol being from about 99:1 to 3:1.

2. The collector combination of claim 1 wherein the ratio of said fatty acid to said alcohol is from about 10:1 to 7:1.

3. The collector combination of claim 1 wherein said fatty acid is tall oil fatty acid.

4. The collector combination of claim 1 wherein said alcohol has 11–15 carbon atoms.

5. The collector combination of claim 4 wherein the value of $n$ of said alcohol is 3.

* * * * *

UNITED STATES PATENT OFFICE

CERTIFICATE OF CORRECTION

Patent No 4,090,972 Dated May 23, 1978

Inventor(s) SAMUEL SHAN-NING WANG and EUGENE LeROY SMITH, Jr.

It is certified that error appears in the above-identified patent and that said Letters Patent are hereby corrected as shown below:

Column 8, line 16, after of, should read --any-- instead of "an".

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*